US007396216B2

(12) United States Patent
Blauch et al.

(10) Patent No.: US 7,396,216 B2
(45) Date of Patent: Jul. 8, 2008

(54) SUBMERSIBLE PUMP ASSEMBLY FOR REMOVING A PRODUCTION INHIBITING FLUID FROM A WELL AND METHOD FOR USE OF SAME

(75) Inventors: Matthew Eric Blauch, Duncan, OK (US); Steven Robert Grundmann, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 270 days.

(21) Appl. No.: 10/127,905

(22) Filed: Apr. 23, 2002

(65) Prior Publication Data

US 2003/0198562 A1 Oct. 23, 2003

(51) Int. Cl.
*F04B 43/12* (2006.01)

(52) U.S. Cl. ..... 417/423.3; 417/53; 166/369

(58) Field of Classification Search ..... 166/369, 166/65.1, 105, 242.2, 242.6, 380, 384, 585, 166/105.5, 66, 66.7, 68; 417/423.3, 53; 138/101, 138/116; 116/118
See application file for complete search history.

(56) References Cited

U.S. PATENT DOCUMENTS

| | | | | | |
|---|---|---|---|---|---|
| 3,493,050 | A | * | 2/1970 | Kelley et al. | 166/267 |
| 4,187,912 | A | * | 2/1980 | Cramer | 166/314 |
| 4,830,113 | A | * | 5/1989 | Geyer | 166/369 |
| 5,155,311 | A | * | 10/1992 | Utke | 200/84 C |
| 5,542,472 | A | * | 8/1996 | Pringle et al. | 166/65.1 |
| 5,868,029 | A | * | 2/1999 | Paine | 73/298 |
| 5,892,860 | A | * | 4/1999 | Maron et al. | 385/12 |
| 5,906,242 | A | * | 5/1999 | Bruewer et al. | 166/378 |
| 5,913,337 | A | * | 6/1999 | Williams et al. | 138/125 |
| 5,960,886 | A | * | 10/1999 | Morrow | 166/369 |
| 6,017,198 | A | * | 1/2000 | Traylor et al. | 417/390 |
| 6,065,540 | A | | 5/2000 | Thomeer et al. | 166/297 |
| 6,082,454 | A | * | 7/2000 | Tubel | 166/250.15 |
| 6,089,322 | A | * | 7/2000 | Kelley et al. | 166/370 |
| 6,257,332 | B1 | * | 7/2001 | Vidrine et al. | 166/250.15 |
| 6,298,917 | B1 | * | 10/2001 | Kobylinski et al. | 166/369 |

FOREIGN PATENT DOCUMENTS

| | | |
|---|---|---|
| WO | WO 00/25001 | 5/2000 |

* cited by examiner

*Primary Examiner*—Charles Freay
*Assistant Examiner*—Vikansha Dwivedi
(74) *Attorney, Agent, or Firm*—Lawrence R. Youst

(57) ABSTRACT

A submersible pump assembly (100) for removing a production inhibiting fluid (102) from a well (110) and method for use of the same is disclosed. The submersible pump assembly (100) includes a composite coiled tubing (120) and a submersible pump (112) coupled to the tubing (120) that is disposed within a fluid accumulation zone (104) of the well (110). The tubing (120) defines a fluid communication path substantially from the fluid accumulation zone (104) to the surface. The submersible pump (112) includes a port (114) for intaking production inhibiting fluid (102). The tubing (120) includes a composite layer in which energy conductors are integrally positioned. The energy conductors provide power to the submersible pump (112) such that the production inhibiting fluid (102) may be pumped from the fluid accumulation zone (104) to the surface via the fluid communication path of the tubing (120).

49 Claims, 5 Drawing Sheets

SUBMERSIBLE PUMP ASSEMBLY FOR REMOVING A PRODUCTION INHIBITING FLUID FROM A WELL AND METHOD FOR USE OF SAME

TECHNICAL FIELD OF THE INVENTION

This invention relates, in general, to enhancing and maintaining hydrocarbon production from a gas well and, in particular, to a submersible pump assembly for the removal of a production inhibiting fluid from a gas well and a method for the use of the same.

BACKGROUND OF THE INVENTION

It is well known in the subterranean well drilling and completion art that it may be desirable to perform a formation fracturing and propping operation to increase the permeability of the formation adjacent to the wellbore. According to conventional practice, a fracture fluid such as water, oil/water emulsion or gelled water is pumped into the formation with sufficient volume and pressure to create and open hydraulic fractures in the production interval. The fracture fluid may carry a suitable propping agent, such as sand, gravel or proppants into the fractures for the purpose of holding the fractures open following the fracture stimulation operation.

The fracture fluid must be forced into the formation at a flow rate great enough to fracture the formation allowing the entrained proppant to enter the fractures and prop the formation structures apart, producing channels which will create highly conductive paths reaching out into the production interval, and thereby increasing the reservoir permeability in the fracture region. As such, the success of the fracture stimulation operation is dependent upon the ability to inject large volumes of fracture fluids into the formation at a pressure above the fracture gradient of the formation and at a high flow rate.

It has been found, however, that following a fracture stimulation operation, the large volume of fracture fluids pumped into the formation migrates back to the well resulting in substantial fluid accumulation. In relatively low pressure or pressure depleted gas producing wells this may present a particular problem. Specifically, the reservoir pressure in some cases is not high enough to unload the fluid from the well. This results in a substantial decrease in the volume of gas production or worse, the hydrostatic pressure of the fluid column completely prevents gas production.

Similarly, as a gas well ages, water encroachment may occur. In a healthy, optimally producing well, high pressure gas flow has the ability to lift this liquid to the surface. Over time, however, as the gas pressures in the formation declines and water production increases, the flow conditions change. The reservoir pressure may no longer be sufficient to unload the well such that water accumulates in the lower section of the well forming a column which further retards gas production. In fact, as the column height increases, the hydrostatic pressure may completely prevent gas production.

Several solutions have been suggested to overcome the fluid accumulation problem and to restore the flow rate of gas producing wells. Two such solutions are jetting and swabbing the well. In jetting, a low density fluid such as a nitrogen is pumped downhole via a coiled tubing unit to lighten the offending liquid column such that the liquid can be lifted to the surface. In swabbing, a swab is operated, for example, on a wireline, to bring fluids to the surface and return the well to a state of natural flow.

The existing solutions, however, are beset with numerous limitations. Jetting and swabbing both require a rig crew to rig up the required equipment, perform the jetting or swabbing operation, then dismantle the equipment after performing the operation. A substantial amount of time and money are associated with rigging up and rigging down. In addition, no gas stream may be produced during these operations. Moreover, with jetting and swabbing, as with any downhole operation that involves killing the well, there is a risk that the well will not come back on line. Furthermore, if the well comes back on line, additional fracture fluids or water may enter the well requiring subsequent jetting or swabbing operations.

Therefore, a need has arisen for a system and method for overcoming the fluid accumulation associated with fracture stimulation treatments and the aging of gas wells. A need has also arisen for such a system and method that restore the flow rate of the gas producing well after fluid accumulation. Further, a need has arisen for such a system and method that do not require mobilizing a rig crew and killing the well to remove fluid accumulation.

SUMMARY OF THE INVENTION

The present invention disclosed herein comprises a submersible pump assembly and a method that are capable of enhancing production from a gas well by removing production inhibiting fluid from the well. The submersible pump assembly comprises a tubing and a submersible pump coupled to the tubing. The tubing defines a communication path substantially from a fluid accumulation zone to the surface for the removal of the production inhibiting fluid. The submersible pump has a port for intaking production inhibiting fluid that is disposed within the production inhibiting fluid. The submersible pump also includes a motor operable to pump production inhibiting fluid to the surface.

The tubing comprises a plurality of composite layers, a substantially impermeable material lining the inner surface of the composite tubular layer that forms a pressure chamber and at least one energy conductor integrally positioned between two of the composite layers. In one embodiment, the energy conductor may be a power line. In this embodiment, the motor is an electrical motor that receives electricity via the power line.

First and second sensors are positioned on the submersible pump assembly. The first sensor is positioned nearer the surface than the second sensor. The first and second sensors control the operational state of the submersible pump. For example, the submersible pump may commence operation when the first sensor detects the presence of the production inhibiting fluid and cease operation when the second sensor no longer detects the presence of the production inhibiting fluid. Preferably, the first and second sensors communicate with the surface by way of a communication line integrally positioned within the tubing.

In one embodiment, the first and second sensors are integrally positioned on the submersible pump. In another embodiment, the first and second sensors may be integrally positioned on the tubing. In yet another embodiment, the first sensor is integrally positioned on the tubing and the second sensor is integrally positioned on the submersible pump. In any of these embodiments, additional sensors may be positioned between the first and second sensors to identify the level of production inhibiting fluid between the first and second sensors. Also, in any of these embodiments, the sensors may sense the presence of the production inhibiting fluid by sensing density, conductivity, pressure, temperature or any other suitable parameter.

In one embodiment, the submersible pump of the present invention may be a single speed pump. In another embodiment, the submersible pump may be a multi-speed pump. In either case, the pump may remove between about one and ten gallons per minute. In one embodiment, the submersible pump may be a centrifugal pump. In another embodiment, the submersible pump may be a positive displacement pump.

In another aspect, the present invention is directed to a method for removing production inhibiting fluid from a fluid accumulation zone of a well. The method comprises the steps of coupling a submersible pump to a composite coiled tubing, running the submersible pump into a fluid accumulation zone of the well, providing power to the submersible pump via an energy conductor and operating the submersible pump to pump the production inhibiting fluid to the surface via a fluid passageway of the composite coiled tubing.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
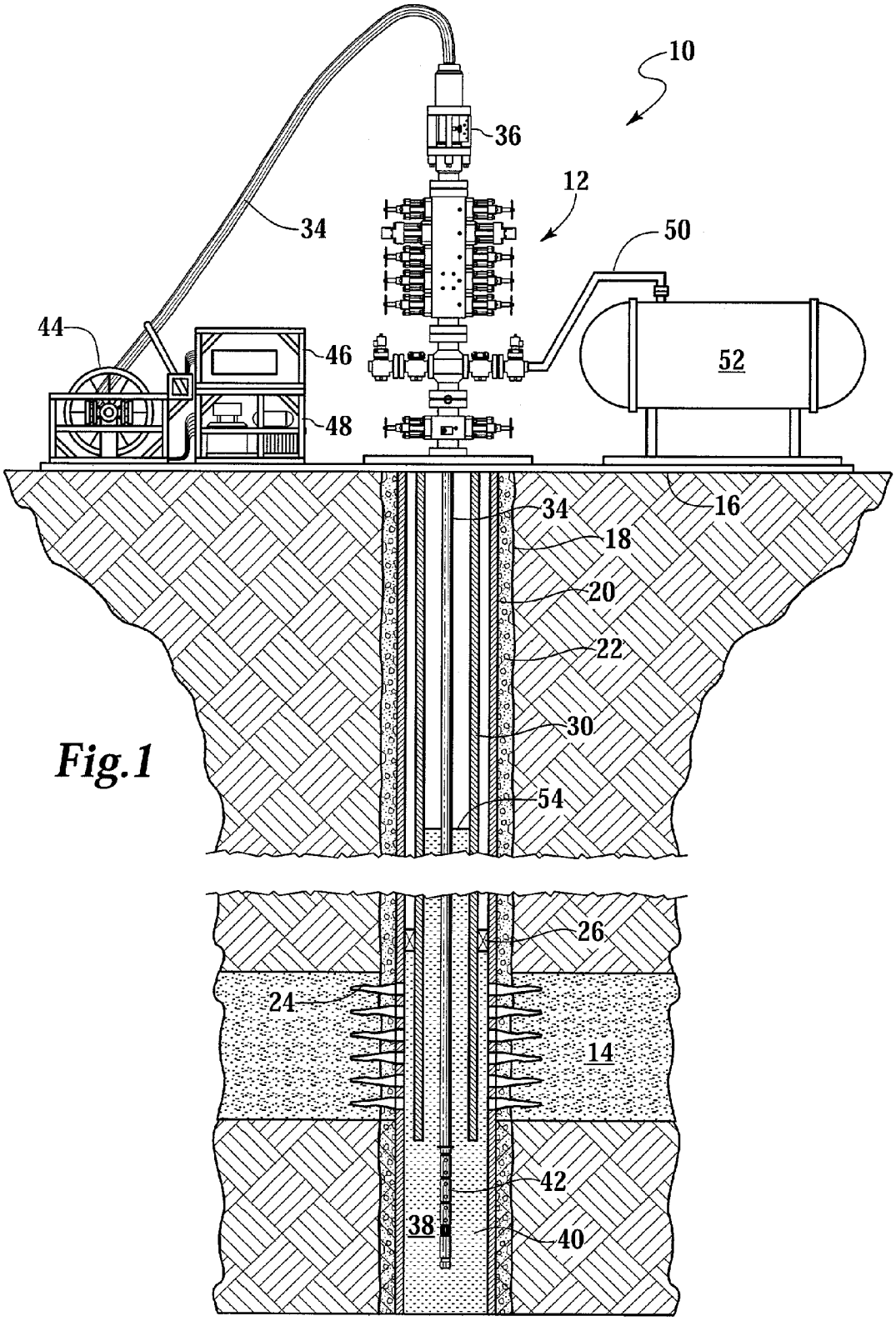
FIG. 1 is a schematic illustration of an onshore gas production operation employing a submersible pump assembly of the present invention for removing a production inhibiting fluid from a well.

Referring initially to FIG. 1, an onshore gas production operation employing a submersible pump assembly of the present invention to remove production inhibiting fluid from a well is schematically illustrated and generally designated 10. Wellhead 12 is positioned over a subterranean gas formation 14 location below the earth's surface 16. A wellbore 18 extends through the various earth strata including formation 14. Wellbore 18 is lined with a casing string 20. Casing string 20 is cemented within wellbore 18 by cement 22. Perforations 24 provide a fluid communication path from formation 14 to the interior of wellbore 18. A packer 26 provides a fluid seal between a production tubing 30 and casing string 20.

A composite coiled tubing 34 runs from surface 16 through a lubricator 36, attached to the upper end of wellhead 12, to a fluid accumulation zone 38 containing a production inhibiting fluid 40 such as fracture fluids or water. Submersible pump 42 is coupled to the lower end of composite coiled tubing 34. Reel 44 feeds composite coiled tubing 34 into lubricator 36 and into wellbore 18. Controller 46 and generator 48 provide the control and power to submersible pump 42, respectively. Flowline 50 connects a pressure vessel 52 to wellhead 12 wherein any liquids carried by the produced gas may be separated therefrom.

To begin the process of removing production inhibiting fluid 40, submersible pump 42 is positioned in fluid accumulation zone 38. As illustrated, the column of fluid forming fluid accumulation zone 38 extends into tubing 30 to a point 54 above formation 14. Preferably, submersible pump 42 is positioned in the portion of fluid accumulation zone 38 below formation 14 and below the lower end of tubing 30. Preferably, submersible pump 42 and composite coiled tubing 34 have a diameter significantly smaller than the diameter of tubing 30 such that gas production is not significantly inhibited by the presence of the submersible pump assembly of the present invention. For example, if tubing 30 has a 2⅜ inch diameter, the diameter of submersible pump 42 and composite coiled tubing 34 may preferably be 1¾ inches or smaller. Preferably, generator 48 provides power to submersible pump 42 via the composite coiled tubing 34 as described below in more detail. Additionally, composite coiled tubing 34 provides a fluid communication path from fluid accumulation zone 34 to the surface.

Figure 2:
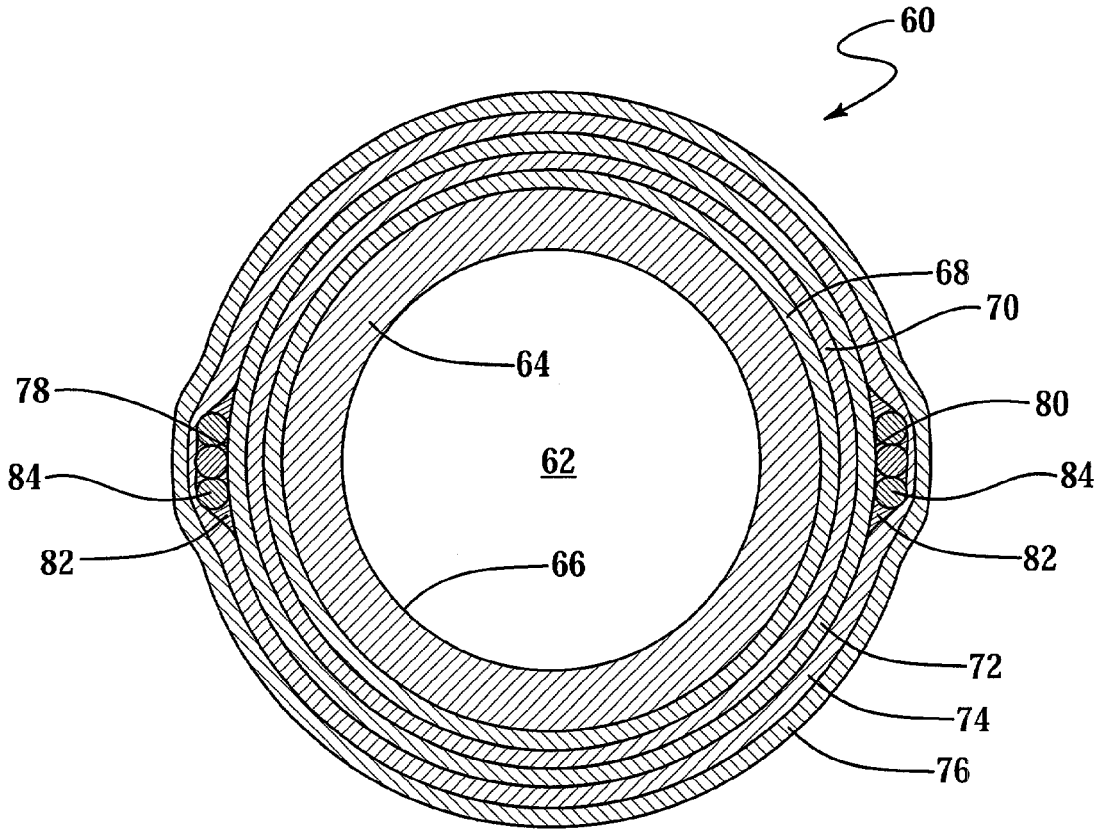
FIG. 2 is a cross sectional view of a composite coiled tubing of the submersible pump assembly of the present invention.

Referring now to FIG. 2, a composite coiled tubing 60 of the submersible pump assembly of the present invention is depicted in cross section. Composite coiled tubing 60 includes an inner fluid passageway 62 defined by an inner thermoplastic liner 64 that provides a body upon which to construct the composite coiled tubing 60 and that provides a relative smooth interior bore 66. Fluid passageway 62 provides a conduit for transporting fluids such as the production inhibiting fluids discussed herein. Layers of braided or filament wound material such as Kevlar or carbon encapsulated in a matrix material such as epoxy surround liner 64 forming a plurality of generally cylindrical layers, such as layers 68, 70, 72, 74, 76 of composite coiled tubing 60.

A pair of oppositely disposed inner areas 78, 80 are formed within composite coiled tubing 60 between layers 72, 74 by placing layered strips 82 of carbon or other stiff material therebetween. Inner areas 78, 80 are configured together with the other structural elements of composite coiled tubing 60 to provide high axial stiffness and strength to the outer portion of composite coiled tubing 60 such that composite coiled tubing 60 has greater bending stiffness about the major axis as compared to the bending stiffness about the minor axis to provide a preferred direction of bending about the axis of minimum bending stiffness when composite coiled tubing 60 is spooled and unspooled.

Accordingly, the materials of composite coiled tubing 60 provide for high axial strength and stiffness while also exhibiting high pressure carrying capability and low bending stiffness. For spooling purposes, composite coiled tubing 60 is designed to bend about the axis of the minimum moment of inertia without exceeding the low strain allowable characteristic of uniaxial material, yet be sufficiently flexible to allow the assembly to be bent onto the spool.

Inner areas 78, 80 have energy conduits 84 that may be employed for a variety of purposes. For example, energy conduits 84 may be power lines, control lines, communication lines or the like that are coupled between the submersible pump and the surface. Specifically, a power line may provide AC or DC power to a motor in the submersible pump and a control or communication line may provide for the exchange of control signals or data between the surface and the submersible pump. Although a specific number of energy conductors 84 are illustrated, it should be understood by one skilled in the art that more or less energy conductors 84 than illustrated are in accordance with the teachings of the present invention.

The design of composite coiled tubing 60 provides for production inhibiting fluid to be conveyed in fluid passageway 62 and energy conductors 84 to be positioned in the matrix about fluid passageway 62. It should be understood by those skilled in the art that while a specific composite coiled tubing is illustrated and described herein, other composite coiled tubings having a fluid passageway and one or more energy conductors could alternatively be used and are considered within the scope of the present intention.

Figure 3:
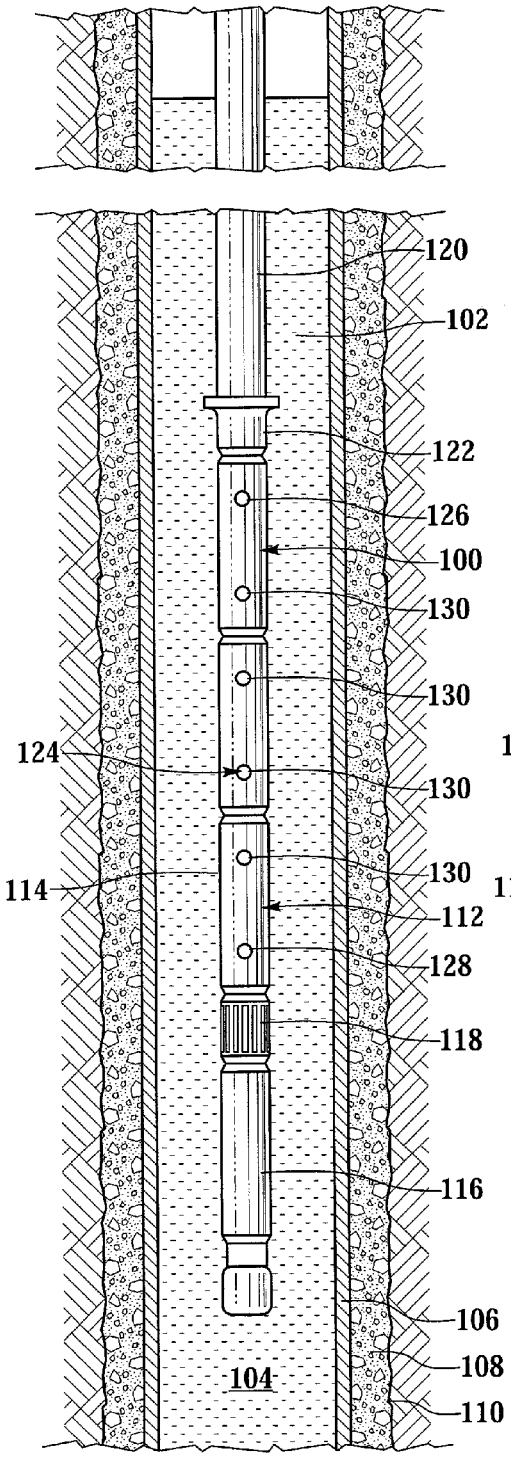
FIG. 3 is a schematic illustration of a submersible pump assembly of the present invention in a first stage of removing the production inhibiting fluid from the well.

Referring now to FIG. 3, therein is depicted a submersible pump assembly 100 of the present invention in a first stage of removing a production inhibiting fluid 102 from a well. As illustrated, submersible pump assembly 100 is positioned in a fluid accumulation zone 104 defined by a casing string 106 cemented by cement 108 to a wellbore 110. A submersible pump 112 includes a pump section 114 driven by a motor 116. An intake port 118 intakes production inhibiting fluid 102 into submersible pump assembly 100 for circulation to the surface via a composite coiled tubing 120. A connector 122 is used to connect submersible pump 112 with composite coiled tubing 120. Intake port 118, pump section 114, and composite coiled tubing 120 thereby create a circulation path for the return of production inhibiting fluid 102 to the surface.

It should be apparent to one skilled in the art that a variety of motors and pumps may be employed in submersible pump assembly 100 of the present invention. An exemplary pump 114, however, is a multi-staged centrifugal or positive displacement pump and an exemplary motor 116 is a three-phase multi-speed induction motor. Moreover, it should be apparent to one skilled in the art that additional components can be added or the sequence of components can be rearranged without departing from the principles of the present invention.

Senors 124 integrally positioned on submersible pump 112 detect the presence of production inhibiting fluid 102. As illustrated, three types of sensors 124 are employed in the submersible pump. A high level sensor 126 is integrally positioned on the submersible pump 112 nearest to the surface. A low level sensor 128 is positioned above the intake port 118. Multiple intermediate sensors 130 are positioned on the submersible pump 112 between high level sensor 126 and low level sensor 128.

High level sensor 126 signals motor 116 to operate pump 114. If motor 116 is a multi-speed motor, high level sensor 126 may signal motor 116 to operate pump 114 at a high rate. Typical pump rates may be between 1 gallon/minute and 10 gallons/minute and may preferably be about 5 gallons/minute. Other rates are possible, however, and considered within the scope of the present invention. Low level sensor 128 signals the motor 116 to cease pumping. Low level sensor 128 prevents the level of production inhibiting fluid 102 from falling below the intake port 118 thus preventing the intake of gas into the pump 114.

Intermediate level sensors 130 allow for the monitoring of the level of production inhibiting fluid 102. In addition, intermediate level sensors 130 may signal motor 116 to operate at varying rates of speed. For example, sensors 124 may form a gradient wherein the rate at which production inhibiting fluid 102 is pumped to the surface is generally proportional to the number of sensors 124 sensing the presence of production inhibiting fluid 102. Sensors 124 may be of any type suitable for detecting the presence or absence of liquid, including, but not limited to, density sensors, conductivity sensors, pressure sensors, temperature sensors or the like. It should be apparent to one skilled in the art that even though six sensors 124 have been depicted and one sensor 124 has been depicted at each sensor level, any number or configuration of sensors 124 that are operable to sense the presence of production inhibiting fluid 102 is in accordance with the teachings of the present invention.

To begin the removal process, submersible pump assembly 100 is positioned in fluid accumulation zone 104. As illustrated, initially, submersible pump 112 is completely submerged in production inhibiting fluid 102. All sensors 124 integrally mounted on submersible pump 112 sense the presence of production inhibiting fluid 102. As high level sensor 126 senses the presence of production inhibiting fluid 102, motor 116 is signaled to begin operation of pump section 114. Submersible pump 112 intakes production inhibiting fluid 102 at intake port 118 and circulates production inhibiting fluid 102 to the surface. In a gas producing well, such as the illustrated well, removal of production inhibiting fluids 102 such as fracture fluids or water by submersible pump assembly 100 of the present invention, allows gas production to come on line or increases existing gas production.

Figure 4:
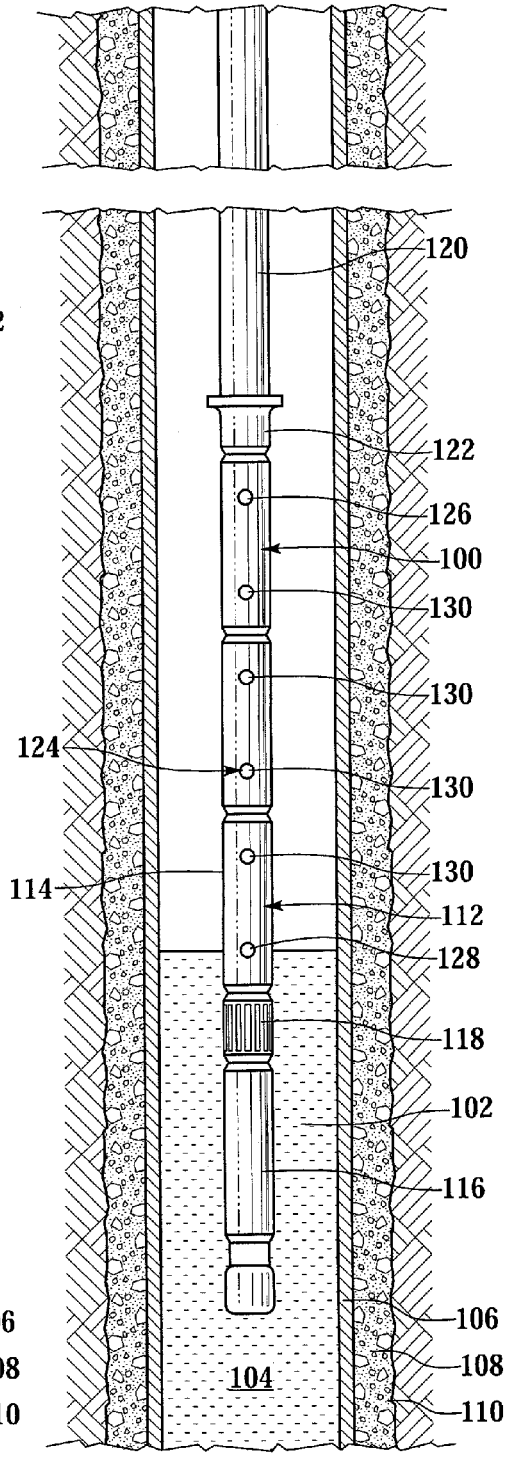
FIG. 4 is a schematic illustration of a submersible pump assembly of the present invention in a second stage of removing the production inhibiting fluid from the well.

As time progresses and submersible pump assembly 100 pumps production inhibiting fluid 102 to the surface, the level of production inhibiting fluid 102 falls. Specifically, referring now to FIG. 4, the process of pumping production inhibiting fluid 102 to the surface continues until the level of production inhibiting fluid 102 has dropped to low level sensor 128. Sensor 128 controls the operational state of the pump section 114 by sending a signal to motor 116 to cease operation. As will be understood by one skilled in the art, intake port 118 should always be submerged in production inhibiting fluid 102. If the intake port 118 should ever be above production inhibiting fluid 102 while pump section 114 is operating, pump section 114 will intake gas that may damage submersible pump assembly 100.

Figure 5:
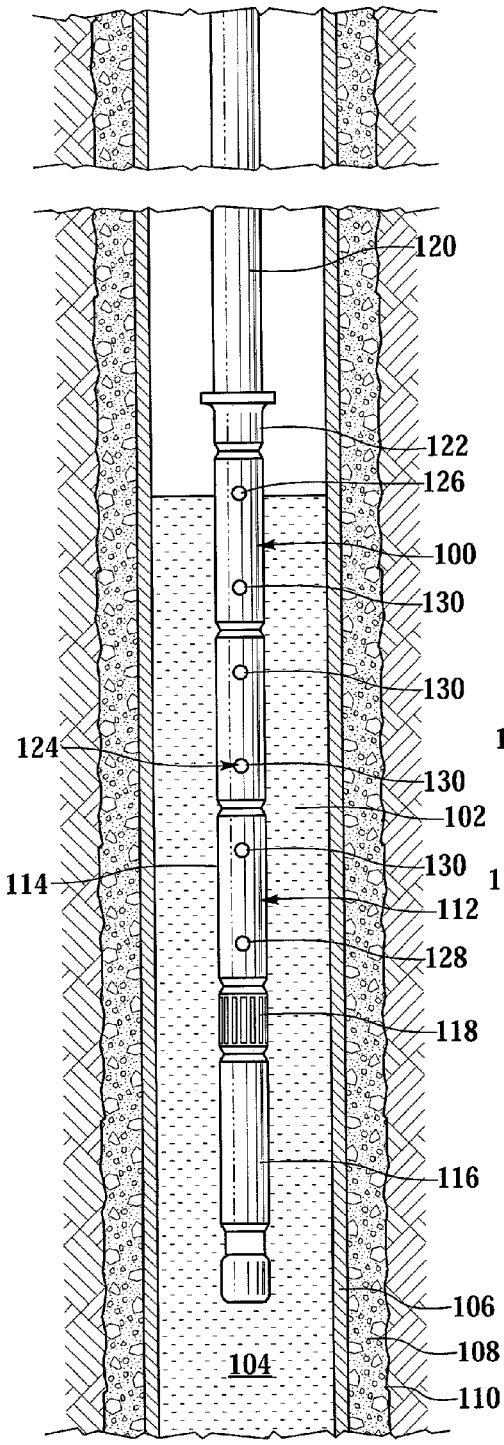
FIG. 5 is a schematic illustration of a submersible pump assembly of the present invention in a third stage of removing the production inhibiting fluid from the well.
Figure 6:
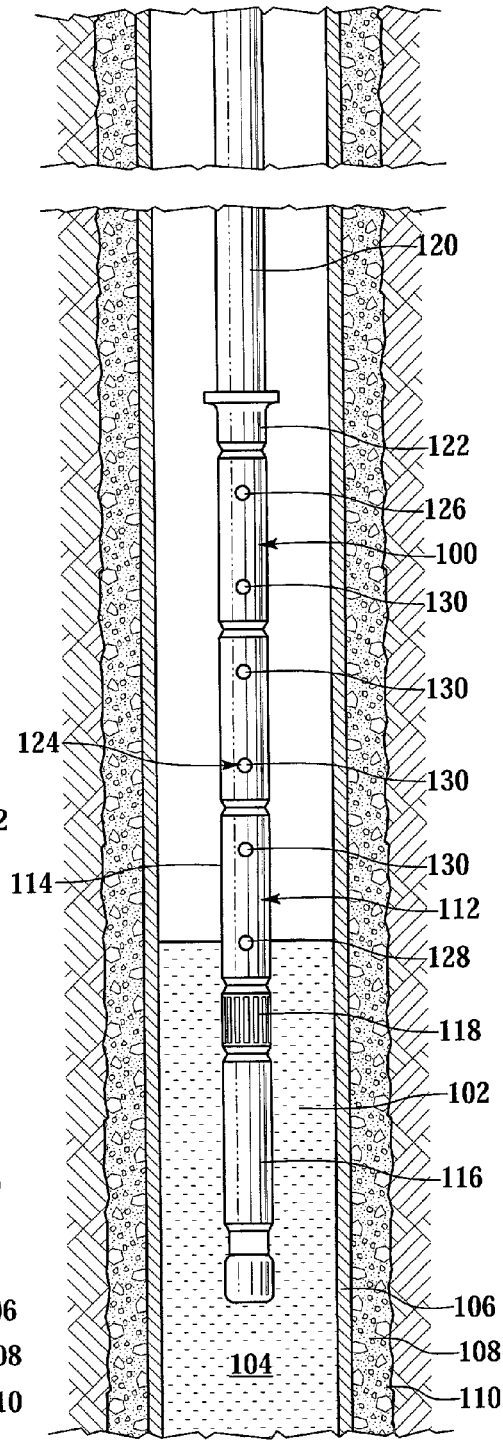
FIG. 6 is a schematic illustration of a submersible pump assembly of the present invention in a fourth stage of removing the production inhibiting fluid from the well.

Once the initial column of production inhibiting fluid 102 has been removed, submersible pump assembly 110 remains in place within wellbore 110 and enters a steady state mode wherein the accumulation of production inhibiting fluid 102 is controlled. Referring to FIG. 5, the level of production inhibiting fluid 102 has risen to high level sensor 126. The level of production inhibiting fluid 102 may rise for a variety of reasons such as continuing desaturation of the fracture fluids from the formation or ongoing water production. In the illustration, when the level of production inhibiting fluids 102 reaches high level sensor 126, a signal is sent to motor 116 to begin operation of pump section 114. As described above, submersible pump 112 intakes production inhibiting fluid 102 at intake port 118 and circulates production inhibiting fluid 102 to the surface. As best seen in FIG. 6, this process of pumping production inhibiting fluid 102 to the surface continues until the level of production inhibiting fluid 102 again drops to low level sensor 128. A signal is sent to the motor 116 to cease operation of pump section 114. This process repeats itself as required to prevent production inhibiting fluid 102 from inhibiting gas production. Accordingly, it should be apparent to one skilled in the art that the operation of the submersible pump assembly of the present invention does not interfere with gas production from the well.

Figure 7:
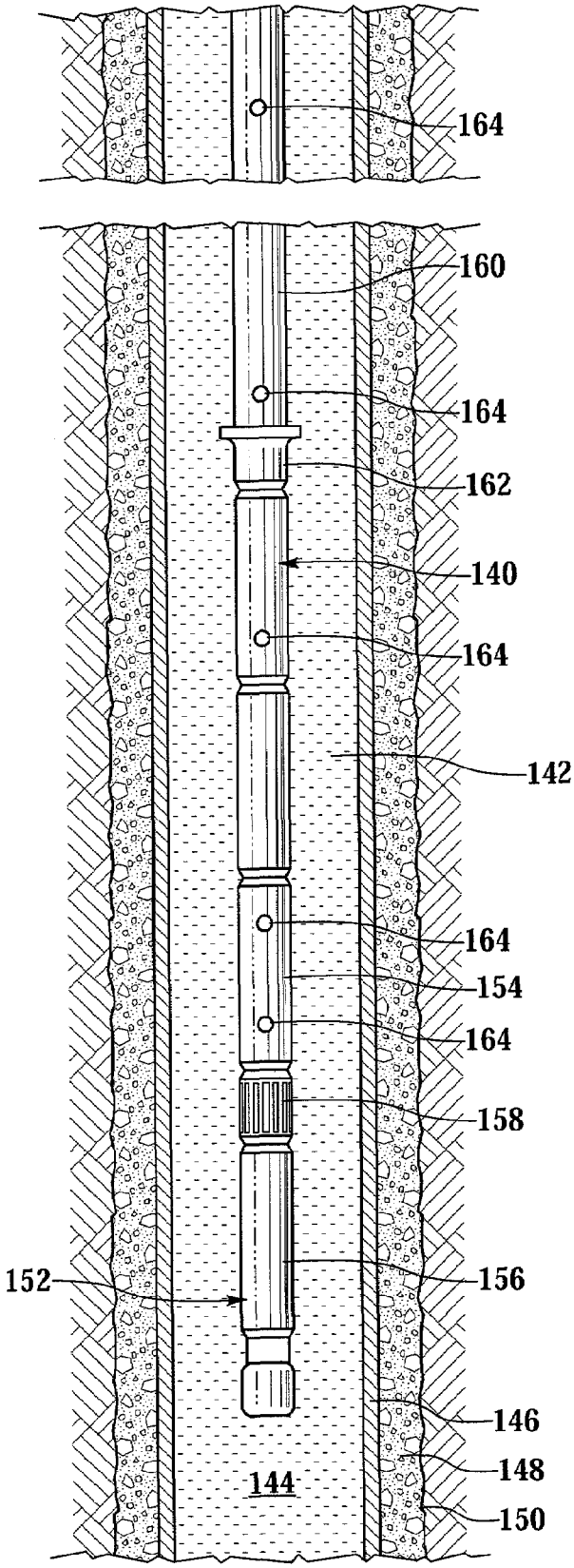
FIG. 7 is a schematic illustration of an alternate embodiment of the submersible pump assembly of the present invention wherein sensors are mounted on the composite coiled tubing.

Referring now to FIG. 7, therein is depicted an alternate embodiment of a submersible pump assembly 140 of the present invention in a first stage of removing a production inhibiting fluid 142 from a well. As illustrated, submersible pump assembly 140 is positioned in a fluid accumulation zone 144 defined by a casing string 146 cemented by cement 148 to a wellbore 150. A submersible pump 152 includes a pump section 154 driven by a motor 156. An intake port 158 intakes production inhibiting fluid 142 into submersible pump assembly 140 for circulation to the surface via a composite coiled tubing 160. A connector 162 is used to connect submersible pump 152 with composite coiled tubing 160.

Senors 164 integrally positioned on submersible pump 152 and composite coiled tubing 160 detect the presence of production inhibiting fluid 142. It should be apparent to one skilled in the art that the sensors 164 may be positioned in any manner on the submersible pump 152 and composite coiled tubing 160. For example, in addition to the embodiments previously described and illustrated, sensors 164 may entirely be positioned on the composite coiled tubing 160.

It should be apparent to one skilled in the art that the present invention provides a system and method for overcoming the fluid accumulation associated with fracture treatments and age in gas wells. The present invention restores the gas flow rate by removing a portion of the offending column of production inhibiting fluid. The present invention does not require mobilizing a rig crew each time production inhibiting fluid has accumulated. Instead, the submersible pump assembly of the present invention may be employed by running a composite coiled tubing and submersible pump through the wellhead of a well and lowering the submersible pump to the liquid accumulation zone. The design of the submersible pump assembly and the design of the composite coiled tubing allows production to continue while the submersible pump assembly is in use.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A submergible pump assembly for removing a production inhibiting fluid from a well, comprising:

a tubing defining a fluid communication path substantially from a fluid accumulation zone in the well to the surface;

a submergible pump coupled to the tubing and disposed within the fluid accumulation zone, the submergible pump having a production inhibiting fluid intake port that intakes production inhibiting fluid; and a plurality of sensors including a first sensor and a second sensor, the first sensor positioned nearer the surface than the second sensor, wherein the plurality of sensors are used to sense a presence of the production inhibiting fluid.

2. The submergible pump assembly as recited in claim 1 wherein the submergible pump further comprises an electrical motor.

3. The submergible pump assembly as recited in claim 1 wherein the tubing further comprises a plurality of composite layers, a substantially impermeable material lining an inner surface of the innermost composite layer forming a pressure chamber and an energy conductor integrally positioned between two of the plurality of composite layers.

4. The submergible pump assembly as recited in claim 3 wherein the energy conductor further comprises a power line.

5. The submergible pump assembly as recited in claim 3 wherein the energy conductor further comprises a communication line.

6. The submergible pump assembly as recited in claim 1 wherein the first and second sensors control the operational state of the submergible pump.

7. The submergible pump assembly as recited in claim 1 wherein the first and second sensors are chosen from the group consisting of density sensors, conductivity sensors, pressure sensors and temperature sensors.

8. The submergible pump assembly as recited in claim 1 wherein the first and second sensors communicate with the surface by way of a communication line embedded in the tubing.

9. The submergible pump assembly as recited in claim 1 wherein the first and second sensors are integrally positioned on the submergible pump.

10. The submergible pump assembly as recited in claim 1 wherein the first sensor is integrally positioned on the tubing and the second sensor is integrally positioned on the submergible pump.

11. The submergible pump assembly as recited in claim 1 wherein the submergible pump commences operation when the first sensor detects the presence of the production inhibiting fluid and wherein the submergible pump ceases operation when the second sensor no longer detects the presence of the production inhibiting fluid.

12. The submergible pump assembly as recited in claim 1 further comprising additional sensors positioned between the first and second sensors that identify the level of the production inhibiting fluid between the first and second sensors.

13. The submergible pump assembly as recited in claim 1 wherein the submergible pump pumps between about 1 and 10 gallons per minute.

14. The submergible pump assembly as recited in claim 1 wherein the submergible pump further comprises a multi-speed pump.

15. The submergible pump assembly as recited in claim 1 wherein the submergible pump further comprises a pump chosen from the group consisting of centrifugal pumps and positive displacement pumps.

16. The submergible pump assembly as recited in claim 1 wherein the submergible pump further comprises a multi-stage pump.

17. A submergible pump assembly for removing a production inhibiting fluid from a well, comprising:

a composite coiled tubular defining a fluid communication path substantially from a fluid accumulation zone in the well to the surface, the composite coiled tubular having a plurality of composite layers and an energy conductor integrally positioned between two of the plurality of composite layers;

a submergible pump coupled to the composite coiled tubular and disposed within the fluid accumulation zone, the submergible pump receiving power from the energy conductor; and first and second sensors in communication with the submergible pump, the first and second sensors controlling the operational state of the submergible pump based upon the presence of the production inhibiting fluid.

18. The submergible pump assembly as recited in claim 17 wherein the first sensor is positioned nearer the surface than the second sensor.

19. The submergible pump assembly as recited in claim 17 wherein the first and second sensors are chosen from the group consisting of density sensors, conductivity sensors, pressure sensors and temperature sensors.

20. The submergible pump assembly as recited in claim 17 wherein the first and second sensors communicate with the surface by way of a communication line embedded between two of the plurality of composite layers in the composite coiled tubular.

21. The submergible pump assembly as recited in claim 17 wherein the first and second sensors are integrally positioned on the submergible pump.

22. The submergible pump assembly as recited in claim 17 wherein the first sensor is integrally positioned on the composite coiled tubular and the second sensor is integrally positioned on the submergible pump.

23. The submergible pump assembly as recited in claim 17 wherein the submergible pump commences operation when the first sensor detects the presence of the production inhibiting fluid and wherein the submergible pump ceases operation when the second sensor no longer detects the presence of the production inhibiting fluid.

24. The submergible pump assembly as recited in claim 17 further comprising additional sensors positioned between the first and second sensor that identify the level of the production inhibiting fluid between the first and second sensors.

25. The submergible pump assembly as recited in claim 17 wherein the submergible pump pumps between about 1 and 10 gallons per minute.

26. The submergible pump assembly as recited in claim 17 wherein the submergible pump further comprises a multi-speed pump.

27. The submergible pump assembly as recited in claim 17 wherein the submergible pump further comprises a pump chosen from the group consisting of centrifugal pumps and positive displacement pumps.

28. The submergible pump assembly as recited in claim 17 wherein the submergible pump further comprises a multi-stage pump.

29. A method f or removing a production inhibiting fluid in a fluid accumulation zone of a well comprising the steps of:

coupling a submergible pump to a composite coiled tubing having an energy conductor embedded between two composite layers and defining a fluid passageway;

running the submergible pump into the fluid accumulation zone of the well;

providing power to the submergible pump via the energy conductor;

sensing a presence of the production inhibiting fluid with a first sensor and a second sensor; and operating the submergible pump to pump the production inhibiting fluid from the fluid accumulation zone to the surface via the fluid passageway of the composite coiled tubing.

30. The method as recited in claim 29 wherein the step of operating the submergible pump further comprises the step of intaking the production inhibiting fluid through a port submerged in the production inhibiting fluid.

31. The method as recited in claim 29 wherein the step of operating the submergible pump further comprises the step of electrically operating the submergible pump to pump the production inhibiting fluid from the fluid accumulation zone to the surface via the fluid passageway of the composite coiled tubing.

32. The method as recited in claim 29 further comprising the step of controlling the operational state of the submergible pump with the first and second sensors.

33. The method as recited in claim 29 further comprising the step of selecting the first and second sensors from the group consisting of density sensors, conductivity sensors, pressure sensors and temperature sensors.

34. The method as recited in claim 29 wherein the step of operating the submergible pump further comprises commencing operation when the first sensor detects the presence of the production inhibiting fluid and ceasing operation when the second sensor no longer detects the presence of the production inhibiting fluid.

35. The method as recited in claim 29 further comprising the step of positioning additional sensors between the first and second sensor, the additional sensors identifying a level of the production inhibiting fluid between the first and second sensors.

36. The method as recited in claim 29 wherein the step of operating the submergible pump further comprises pumping between about 1 and 10 gallons per minute.

37. A method for removing a production inhibiting fluid in a fluid accumulation zone of a well comprising the steps of:

coupling a submergible pump to a composite coiled tubing having an energy conductor embedded between two composite layers and defining a fluid passageway;

running the submergible pump into the fluid accumulation zone of the well;

providing power to the submergible pump via the energy conductor;

sensing the presence of the production inhibiting fluid with first and second sensors;

operating the submergible pump to pump the production inhibiting fluid from the fluid accumulation zone to the surface via the fluid passageway of the composite coiled tubing when the first sensor detects the presence of the production inhibiting fluid; and ceasing operating the submergible pump when the second sensor no longer detects the presence of the production inhibiting fluid.

38. The method as recited in claim 37 wherein the step of operating the submergible pump further comprises the step of intaking the production inhibiting fluid through a port submerged in the production inhibiting fluid.

39. The method as recited in claim 37 further comprising the step of selecting the first and second sensors from the group consisting of density sensors, conductivity sensors, pressure sensors and temperature sensors.

40. The method as recited in claim 37 further comprising the step of positioning additional sensors between the first and second sensor, the additional sensors idontify a level of the production inhibiting fluid between the first and second sensors.

41. The method as recited in claim 37 wherein the step of operating the submergible pump further comprises pumping between about 1 and 10 gallons per minute.

42. A system for removing a production inhibiting fluid from a well, comprising:

a production tubing defining a fluid communication path for gas production;

a production inhibiting fluid tubing disposed within the production tubing and extending into a fluid accumulation zone, the production inhibiting fluid tubing defining a fluid communication path substantially from a fluid accumulation zone in the well to the surface;

a submergible pump coupled to the production inhibiting fluid tubing and disposed within the fluid accumulation zone, the submergible pump intaking production inhibiting fluid for removal from the well; and a plurality of sensors including a first sensor and a second sensor, the first sensor positioned nearer the surface than the second sensor, wherein the plurality of sensors are used to sense a presence of the production inhibiting fluid.

43. The system as recited in claim 42 wherein the first and second sensors control the operational state of the submergible pump.

44. The system as recited in claim 42 wherein the first and second sensors are chosen from the group consisting of density sensors, conductivity sensors, pressure sensors and temperature sensors.

45. The system as recited in claim 42 wherein the first and second sensors communicate with the surface by way of a communication line embedded in the production inhibiting fluid tubing.

46. A submergible pump assembly for removing a production inhibiting fluid from a well, comprising:

a production tubing defining a fluid communication path for gas production;

a production inhibiting fluid tubing disposed within the production tubing and extending into a fluid accumulation zone, the production inhibiting fluid tubing defining a fluid communication path substantially from the fluid accumulation zone in the well to the surface;

a submergible pump coupled to the production inhibiting fluid tubing and disposed within the fluid accumulation zone, the submergible pump intaking production inhibiting fluid for removal from the well; and a plurality of sensors coupled to the production inhibiting fluid tubing and positioned nearer the surface than the submergible pump, the plurality of sensors used to sense the presence of the production inhibiting fluid.

47. The submergible pump assembly as recited in claim 46 wherein the plurality of sensors controls the operational state of the submergible pump.

48. The submergible pump assembly as recited in claim 46 wherein the plurality of sensors is selected from the group consisting of density sensors, conductivity sensors, pressure sensors and temperature sensors.

49. The submergible pump assembly as recited in claim 46 wherein the plurality of sensors communicates with the surface by way of a communication line embedded in the production inhibiting fluid tubing.

* * * * *